US005746521A

United States Patent [19]

Schoen et al.

[11] Patent Number: 5,746,521

[45] Date of Patent: May 5, 1998

[54] THERMAL PRINTHEAD WITH INTEGRATED PRINTHEAD POSITION SENSOR

[75] Inventors: Joel A. Schoen, Woodinville; Jay M. Miazga, Marysville, both of Wash.

[73] Assignee: Intermec Corporation, Everett, Wash.

[21] Appl. No.: 771,588

[22] Filed: Dec. 20, 1996

[51] Int. Cl.[6] ..... B41J 29/38

[52] U.S. Cl. ..... 400/120.16; 400/55; 400/174

[58] Field of Search ..... 400/54, 55, 56, 400/57, 58, 59, 120.16, 174, 175; 347/197

[56] References Cited

U.S. PATENT DOCUMENTS

| | | | |
|---|---|---|---|
| 4,265,556 | 5/1981 | Krieg et al. | 400/342 |
| 4,685,815 | 8/1987 | Baranyi | 400/54 |
| 4,743,129 | 5/1988 | Keryhuel et al. | 400/582 |
| 4,838,713 | 6/1989 | Kunimitsu et al. | 346/76 PH |
| 4,881,840 | 11/1989 | Rendon et al. | 400/705.1 |
| 5,090,829 | 2/1992 | Lee et al. | 400/705.1 |
| 5,156,478 | 10/1992 | Jobs | 400/705 |
| 5,193,918 | 3/1993 | Lohrmann et al. | 400/56 |
| 5,316,395 | 5/1994 | Imai | 400/58 |
| 5,397,192 | 3/1995 | Khormaee | 400/708 |
| 5,476,331 | 12/1995 | Ohama | 400/216 |
| 5,628,572 | 5/1997 | Sato et al. | 400/120.16 |

*Primary Examiner*—Edgar S. Burr
*Assistant Examiner*—Steven S. Kelley
*Attorney, Agent, or Firm*—Graham & James LLP

[57] ABSTRACT

A thermal printer is provided with an integrated sensor that detects the printhead position without requiring a custom cable assembly or other sensing components. The thermal printer comprises a rotatable platen and a printhead disposed relative to each other to define a print region therebetween through which a print media is transported. The printhead may be selectively pivoted between a closed position abutting the platen and an open position substantially separated from the platen. The printhead is operable to print information onto the print media as the print media is transported by rotation of the platen when the printhead is pivoted to the closed position. The printhead further comprises a circuit board coupled thereto that is pivotable in cooperation with the printhead. The circuit board is operably coupled to a central controller to receive control signals and provide the control signals to the printhead. The circuit board further has first and second electrical contact points disposed on a surface thereof that are electrically connected to the central controller. A bridge element is fixedly disposed relative to the printhead to come into contact with the first and second contact points only when the printhead is pivoted to a selected one of the open and closed positions, thereby providing a printhead status signal to the central controller indicating that the printhead is pivoted to the selected one of the open and closed positions.

18 Claims, 5 Drawing Sheets

THERMAL PRINTHEAD WITH INTEGRATED PRINTHEAD POSITION SENSOR

BACKGROUND OF THE INVENTION

1. Field of the Invention

The present invention relates to thermal printing, and more particularly, to a sensor integrated into the thermal printhead for detecting whether the printhead is pivoted to a closed position or an open position.

2. Description of Related Art

In the field of bar code symbology, vertical bars of varying thicknesses and spacing are used to convey information, such as an identification of the object to which the bar code is affixed. Bar codes are often printed onto a print media comprising individual paper substrate labels having an adhesive backing layer that enables the labels to be affixed to objects to be identified. Since the bar and space elements have differing light reflective characteristics, the information contained in the bar code can be read by interpreting the reflected light or image pattern from the bar code using known optical scanning systems. In order to accurately read the bar code, it is thus essential that the bar code be printed in a high quality manner, without any streaking, blurring or misregistration of the bar code. At the same time, it is essential that the adhesive backing layer of the labels not be damaged by heat generated during the printing process.

In view of these demanding printing requirements, bar codes are often printed using direct thermal or thermal transfer printing techniques. In direct thermal printing, the print media is impregnated with a thermally sensitive chemical that is reactive upon exposure to heat for a period of time. Thermal transfer printing requires an ink ribbon that is selectively heated to transfer ink to the print media. These two printing techniques are referred to collectively herein as thermal printing.

To print the bar code, the print media is drawn between a platen and a thermal printhead of the printer. The thermal print-head has linearly disposed printing elements that extend across a width dimension of the print media. The printing elements are individually activated in accordance with instructions from a printer controller. As each printing element is activated, the thermally active chemical of the ribbon activates at the location of the particular printing element to transfer ink to the printed area of the print media. The print media is continuously drawn through the region between the platen and the thermal printhead, and in so doing, the bar code is printed onto the print media as it passes through the region. Other images, such as text, characters or graphics, can be printed in the same manner.

In order to facilitate periodic replacement of the print media or cleaning of the thermal printhead, it is known to provide the printhead with a mount that permits pivotal movement of the printhead between closed (or operational) and open (or non-operational) positions. When pivoted to the closed position, the printhead is moved toward the platen with the print media pressed therebetween. This printhead pressure permits the rotating platen to advance the print media during printing operations. Conversely, when the printhead is pivoted to the open position, the printhead is moved away from the platen, thus removing the pressure applied to the print media and preventing advancement of the print media.

A drawback of such a pivotably mounted printhead is that the printhead may be inadvertently left open after cleaning or loading of print media. In such a condition, a host computer coupled to the printer may download a print job to the printer which will then attempt to execute the print job. Because of loss of printhead pressure due to the printhead being open, the print media will not advance even though the printhead is attempting to print. As a result, information provided to the printhead may be lost until the printer detects a fault condition from the lack of print media movement. In a worst case scenario, such a fault condition may not be recognized until after an entire print job has been lost. In addition, the printing elements may overheat and become damaged due to the absence of contact between the printing elements and the print media. Ordinarily, the print media acts as a heat sink to absorb heat from the printing elements during printing operations.

To remedy these problems, it is known to include a sensor that indicates whether the printhead is in the closed or open position. The sensor permits the printer to recognize the printhead status and notify the host computer to postpone any print jobs while the printhead is in an open position. Generally, the sensor comprises a switch, such as an electromechanical microswitch or optical switch, that is activated by physical movement of the printhead. The switch must further be coupled to the printer controller by a wiring harness that is routed through the printer. Despite the advantages of a printhead status sensor, the addition of the switch and cable assembly often add cost to the printer, exacerbate mounting interface and cable routing problems, and adversely affect overall printer reliability. These disadvantages are especially significant when attempting to retrofit sensor systems into older printers that originally lacked printhead position sensors.

Accordingly, it would be desirable to provide a sensor for a thermal printer that detects the printhead position without requiring a custom cable assembly or other sensing components. It would further be desirable to integrate such as sensor into the thermal printhead and utilize the existing printhead cabling to connect with the printer controller, thus reducing cost and complexity, increasing reliability, and eliminating cable routing and mechanical interface issues.

SUMMARY OF THE INVENTION

In accordance with the teachings of the present invention, a thermal printer is provided with an integrated sensor that detects the printhead position without requiring a custom cable assembly or other sensing components. The thermal printer comprises a rotatable platen and a printhead disposed relative to each other to define a print region therebetween through which a print media is transported. The printhead may be selectively pivoted between a closed position abutting the platen and an open position substantially separated from the platen. The printhead is operable to print information onto the print media as the print media is transported by rotation of the platen when the printhead is pivoted to the closed position. The printhead further comprises a circuit board coupled thereto that is pivotable in cooperation with the printhead.

The printer further includes a central controller that provides control signals that define desired printing operations of the printhead and the platen. The circuit board is operably coupled to the central controller to receive the control signals and provide the control signals to the printhead. The circuit board further has first and second electrical contact points disposed on a surface thereof that are electrically connected to the central controller. An electrically conductive bridge element is fixedly disposed relative to the printhead to come into contact with the first and second contact points only when the printhead is pivoted to a selected one of the open and closed positions. The first and second contact points are thereby electrically connected together to provide a printhead status signal to the central controller indicating that the printhead is pivoted to the selected one of the open and closed positions.

In an embodiment of the invention, the first and second contact points are disposed on a downward facing surface of the circuit board and the open position of the printhead is upward in relation to the closed position. A multi-line interconnect cable is coupled between the circuit board and the central controller for communication of the control signals, and provides at least one previously unused line. The first contact point is coupled to ground and the second contact point is coupled to the previously unused line. When the printhead is pivoted downward to the closed position, the bridge comes into contact with the first and second contact points. As a result, the printhead status signal indicates that the printhead is pivoted to the closed position.

In an alternative embodiment of the invention, the circuit board further comprises a thermistor element adapted to provide a signal to the central controller corresponding to a temperature value of the printhead. The first and second electrical contacts are coupled to respective terminals of the thermistor. The first and second contact points are disposed on an upward facing surface of the circuit board so that the bridge shorts across the thermistor when the printhead is pivoted to the open position. As a result, the printhead status signal indicates that the printhead is pivoted to the open position.

A more complete understanding of a thermal printhead with an integrated printhead position sensor will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1:
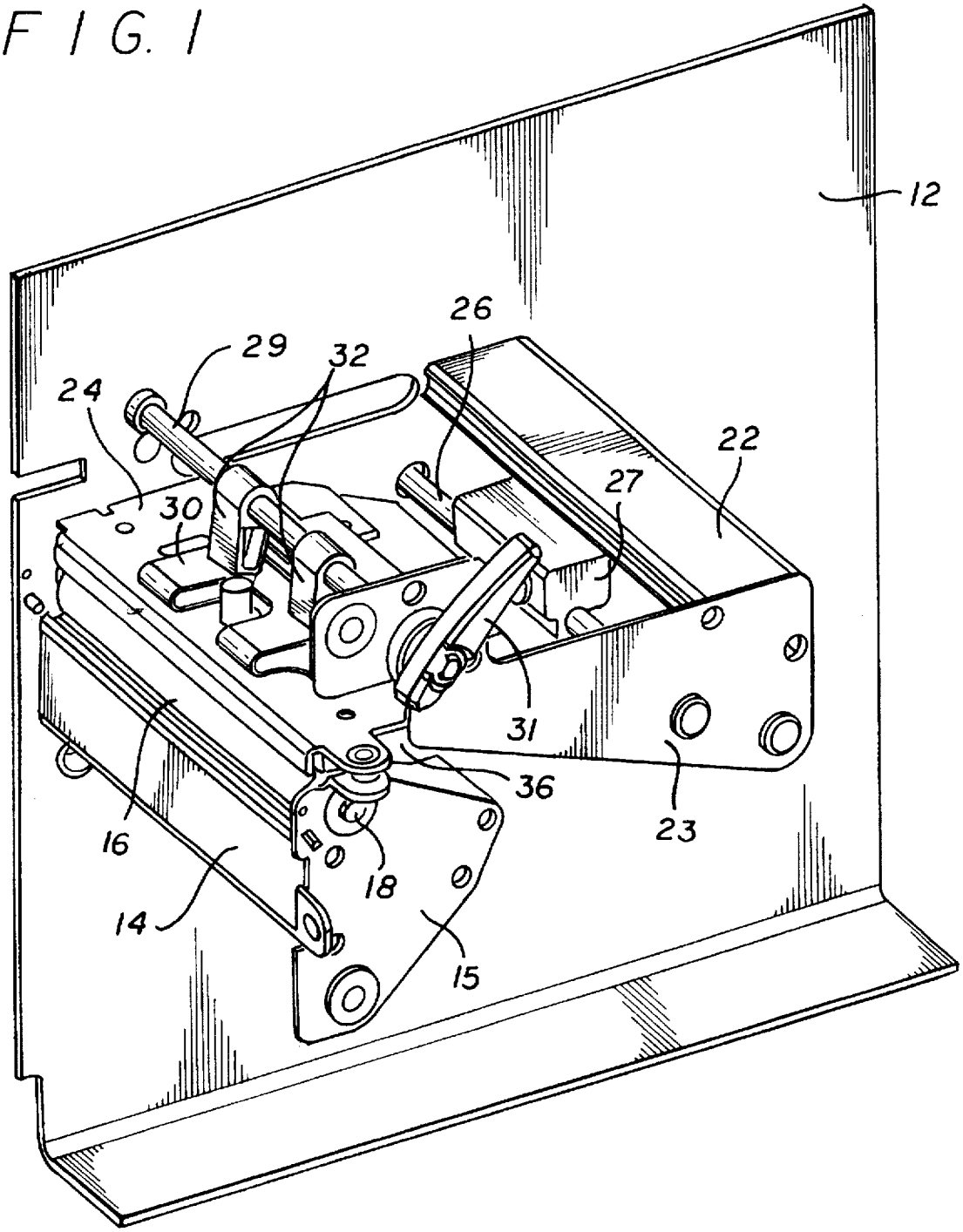
FIG. 1 is a perspective view of an operative portion of a thermal printer showing a platen and thermal printhead.

The present invention satisfies the need for a sensor for a thermal printer that detects the printhead position without requiring a custom cable assembly or other sensing components. As will be further described below, the sensor is integrated into the thermal printhead and utilizes the existing printhead cabling to connect with the printer controller, thus reducing unnecessary cost and complexity, increasing reliability, and eliminating cable routing and mechanical interface issues. In the detailed description that follows, like reference numerals are used to identify like elements illustrated in one or more of the figures.

Figure 2:
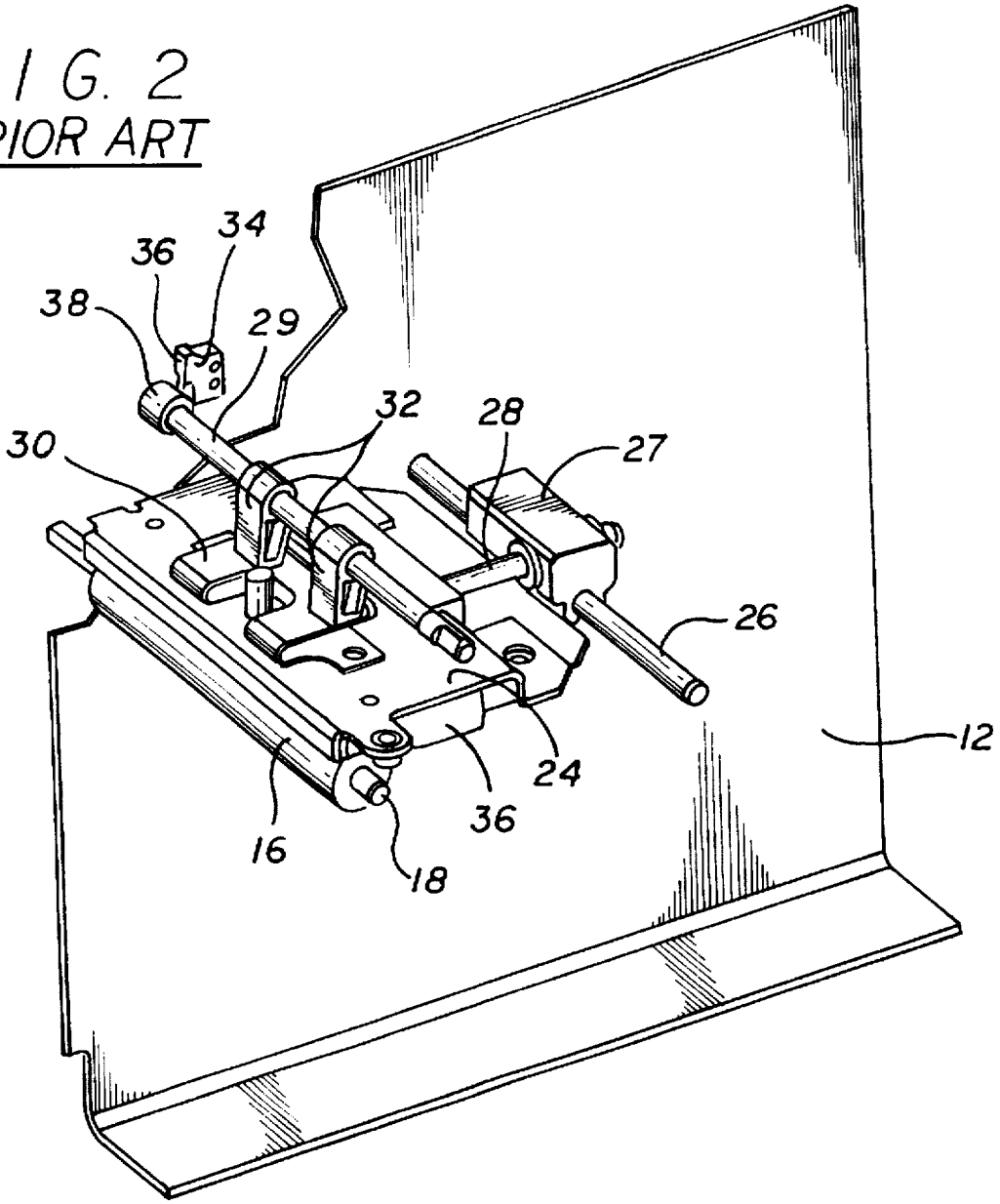
FIG. 2 PRIOR ART
FIG. 2 is a partial perspective view of the platen and printhead utilizing a prior art printhead position switch.

Referring first to FIGS. 1 and 2, a print region of a thermal printer is illustrated from a perspective view. The thermal printer comprises a mounting deck 12 that provides a structural frame to which the operative portions of the printer are securely mounted. A platen support frame 14 is attached to the mounting deck 12, and has an end frame 15 coupled thereto which extends in parallel to the mounting deck. A platen roller 16 is carried by the platen support frame 14, and further includes an axle 18. A first end of the axle 18 extends outwardly through a corresponding opening through the end frame 15 and a second end of the axle (not shown) extends through a corresponding opening through the mounting deck 12. Accordingly, the platen roller 16 can be driven to rotate about the axle 18 by a motor or other known driving mechanism (not shown) coupled to the platen roller, thereby driving a print media.

A printhead support frame 22 is attached to the mounting deck 12, and has an end frame 23 coupled thereto which extends in parallel to the mounting deck. A printhead support assembly 24 is carried by the printhead support frame 22 in a pivotable manner by use of a pivot shaft 26, a yoke 27 and an arm 28. A first end of the pivot shaft 26 extends outwardly through a corresponding opening through the end frame 23 and a second end of the pivot shaft (not shown) extends through a corresponding opening through the mounting deck 12. The pivot shaft 26 is rigidly coupled to the printhead support assembly 24 by the yoke 27 affixed to the pivot shaft, and the arm 28 extends between the yoke and a portion of the printhead support assembly. The printhead support assembly 24 is thus adapted to pivot about the axis defined by the pivot shaft 26.

The pivoting movement of the printhead support assembly 24 is controlled by a mechanism including a pressure spring 30, a release shaft 29, a release handle 31 and a pair of pressure fingers 32. A first end of the release shaft 29 extends outwardly through a corresponding opening through the end frame 23 and a second end of the release shaft (not shown) extends through a corresponding opening through the mounting deck 12. The release handle 31 is coupled to the first end of the release shaft 29 in a position accessible to an operator of the printer. The pressure spring 30 is generally U-shaped having an end coupled to an upper surface of the printhead support assembly 24. The pressure fingers 32 extend radially from a central portion of the release shaft 29 adjacent to the pressure spring 30. By rotating the release handle 31 in a counter-clockwise manner (as seen in FIG. 1), the pressure fingers 32 rotate into contact with an upper surface of the pressure spring 30, forcing the printhead support assembly 24 to pivot counter-clockwise about the pivot shaft 26. Conversely, rotating the release handle 31 in a clockwise manner causes the pressure fingers 32 to rotate out of contact with the pressure spring 30, permitting the printhead support assembly 24 to pivot clockwise about the pivot shaft 26.

A thermal printhead 36 is coupled to a lower surface of the printhead support assembly 24. The thermal printhead 36 comprises a linear array of printing elements that extend in parallel with the platen 16. Each of the printing elements is individually activated in accordance with instructions from a printer controller to print information on a print media transported between the thermal printhead 36 and the platen 16. With the release handle 31 rotated counter-clockwise, the pressure fingers 32 pressing against the upper surface of the pressure spring 30 provides a biasing force on the printhead support assembly 24 which forces the thermal printhead 36 to abut the platen 16, i.e., the closed position. A print media disposed between the thermal printhead 36 and the platen 16 is thereby pressed against the platen by the printhead, and rotation of the platen causes the print media to be driven. By rotating the release handle 31 clockwise, the pressure fingers 32 release the pressure applied by the thermal printhead 36 onto the platen 16, i.e., the open position, at which the print media cannot be driven by rotation of the platen.

Figure 3:
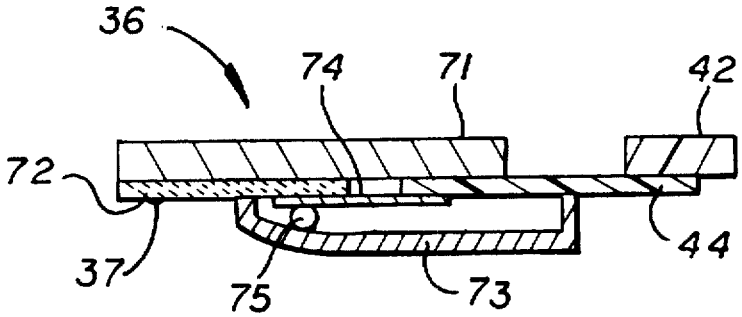
FIG. 3 is a side sectional view of the printhead.

An exemplary printhead 36 is illustrated in greater detail in FIG. 3. The printhead 36 comprises a heatsink 71 onto which a ceramic substrate 72 is disposed. The printing elements 37 are provided on the substrate 72 in the form of a thin metal film that appear as a row of dots across the surface of the substrate. Note that the thickness of the printing elements 37 is exaggerated in FIG. 3 for ease of illustration. The heatsink 71 serves as a mounting base for the substrate 72, and conducts heat away from the printing elements 37 and the substrate. The heatsink 71 is comprised of a thermally conductive material, such as aluminum. A circuit board 44 is also coupled to the heatsink 71, and extends beyond an end of the heatsink opposite from the printing elements 37. The circuit board 44 provides electrical connection to the printhead 36, and may further include other electrical components, such as driver or buffer integrated circuits devices for operating the printing elements 37. A connector 42 is provided on the circuit board 44, and permits a printhead cable (described below) to be electrically connected thereto. A flex-circuit 74 extends between an end of the circuit board 44 and the substrate 72 to provide an electrical connection to conductive traces that extend across the substrate to the printing elements 37. An elastomeric rod 75 is used to maintain positive contact between the flex-circuit 74 and the substrate 72. A cover 74 encloses both the flex-circuit 74 and elastomeric rod 75, as well as portions of the substrate 72 and the circuit board 44, to protect the flex-circuit from mechanical damage and shield it from any electric field effects.

Figure 4A:
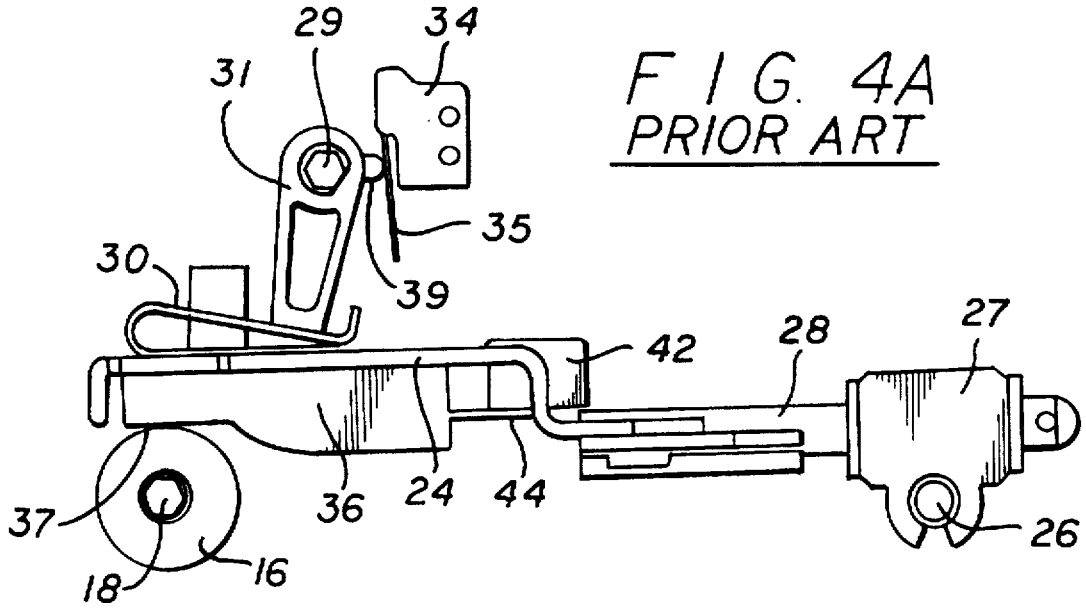
FIG. 4A PRIOR ART
FIGS. 4A and 4B are side views of the prior art printhead position microswitch with the printhead in the open and closed positions, respectively.
Figure 4B:
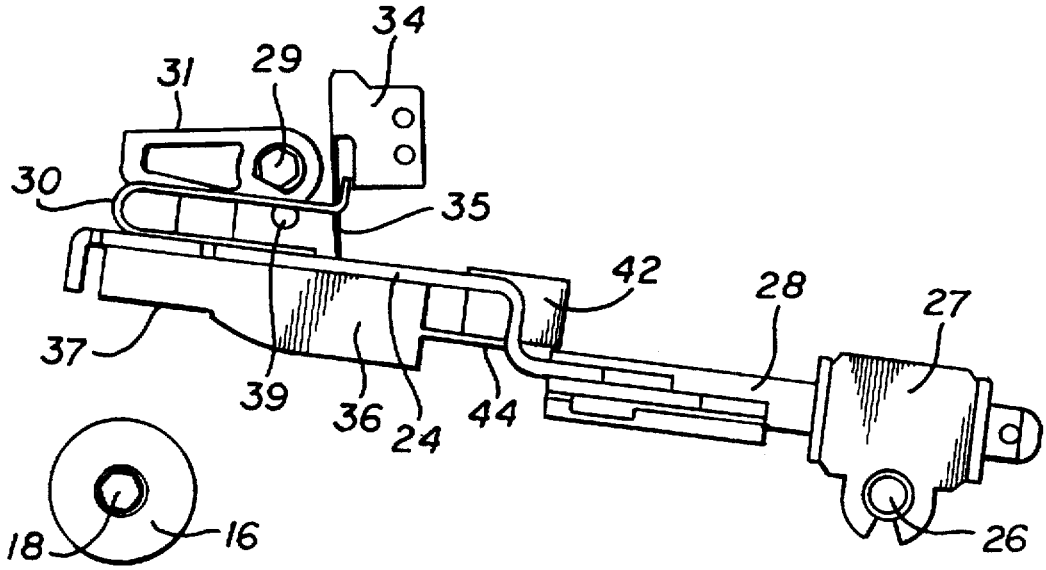
FIG. 4B PRIOR ART

An example of a prior art printhead position switch 34 is illustrated in FIG. 2. The printhead position switch 34 is fixedly disposed to the mounting deck 12, and has a pole element 35 that engages a cam 38 on the release shaft 29. The printhead position switch 34 may be comprised of a low current, minimum contact pressure device commonly referred to as a microswitch. As illustrated in FIGS. 4A and 4B, the printhead position switch 34 toggles between actuated and released positions by rotation of the release shaft 29. In particular, the cam 38 includes a lobe 39 that protrudes radially outward from the shaft 29. With the release handle 31 rotated into the closed position of the thermal printhead 36 (see FIG. 4A), the lobe 39 extends into engagement with the pole element 35 to toggle the printhead position switch 34 to the actuated position. Conversely, with the release handle 31 rotated into the open position of the thermal printhead 36 (see FIG. 4B), the lobe 39 rotates out of engagement with the pole element 35 to toggle the printhead position switch 34 to the released position. The printhead position switch 34 is connected to a central controller of the printer by dedicated electrical cabling (not shown) to provide an electrical signal corresponding to the toggle position of the switch, and in so doing, provide an indication of the pivot position of the thermal printhead 36.

Figure 5A:
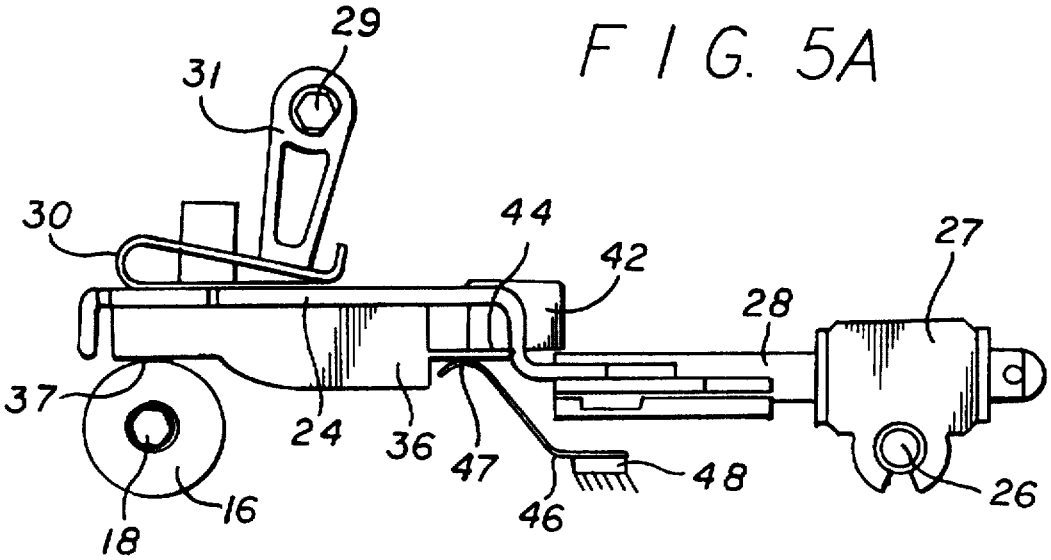
FIGS. 5A and 5B are side views of an integrated printhead position sensor of the present invention with the printhead in the open and closed positions, respectively.
Figure 5B:
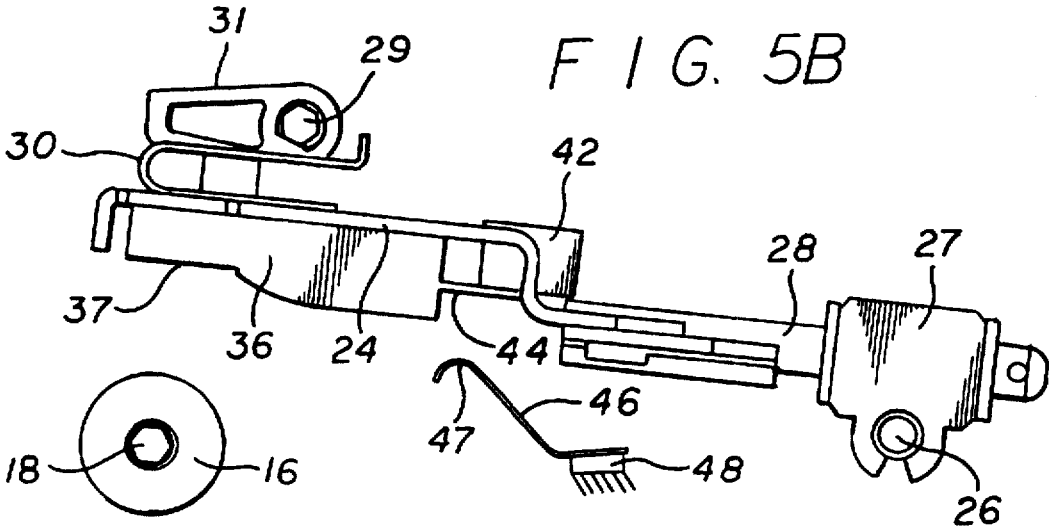
Figure 6:
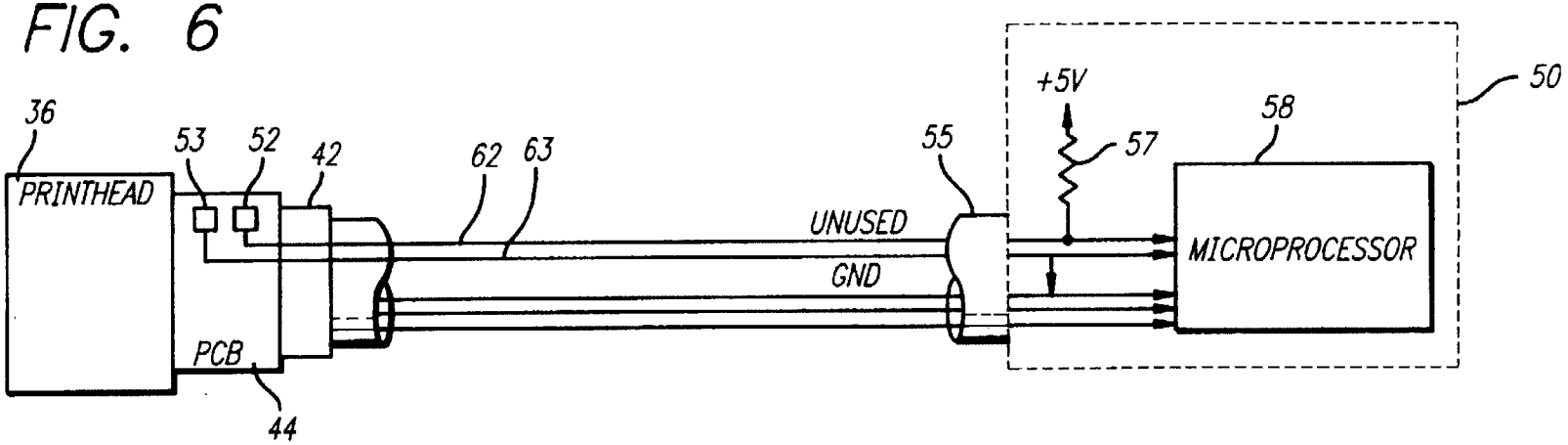
FIG. 6 is a block diagram illustrating electrical connection of the integrated printhead position sensor.

Referring now to FIGS. 5A, 5B, and 6, an integrated printhead position sensor of the present invention is illustrated. As noted above, the connector 42 provided on the circuit board 44 permits a printhead cable 55 (see FIG. 6) to be electrically connected thereto. The printhead cable 55 may comprise a plurality of individual lines that are formed together into a common bus, such as a conventional ribbon cable, with at least one of the individual lines being an unused spare line. The circuit board 44 includes a plurality of printed circuit board traces that are electrically connected to respective pins of the connector 42, such as by soldering. As illustrated in FIG. 6, two additional contact points 52, 53 are provided on the downward facing surface of the circuit board 44 which are connected by printed circuit board traces to two respective ones of the pins of the connector 42. As known in the art, the contact points may be defined in the printed circuit board artwork that is used to form the printed circuit board traces, and are comprised of conductive metal pads disposed on the surface of the circuit board 44. A first one of the contact points 52 is electrically connected to a previously unused data line 62, and a second one of the contact points 53 is electrically connected to a ground line 63.

The contact points 52, 53 are precisely located on the circuit board 44 to come into contact with a bridge element 46 when the printhead support assembly 24 is pivoted to the closed position. The bridge element 46 is fixedly coupled to a bracket 48 so that the bridge element remains stationary with respect to the printhead support assembly 24. The bridge element 46 further comprises a spring contact 47 comprised of a compliant and conductive material, such as metal, having a curved portion at an end distal from the fixed end coupled to the bracket 48. With the release handle 31 rotated into the closed position of the thermal printhead 36 (see FIG. 5A), the bridge element 46 comes into engagement with the contact points 52, 53 to electrically couple the contact points together. Conversely, with the release handle 31 rotated into the open position of the thermal printhead 36 (see FIG. 5B), the bridge element 46 comes out of engagement with the contact points 52, 53 to disconnect the contact points from each other.

As illustrated in FIG. 6, the printhead cable 55 is coupled to a central controller 50 of the printer. The central controller 50 commands the operation of the printer, and includes a conventional microprocessor 58. The central controller 50 may further include memory devices coupled to the microprocessor 58 to provide temporary data storage for operation of the microprocessor, as well as non-volatile storage of an instruction set, i.e., software, that is executed in a sequential manner by the microprocessor to control the overall operation of the printer. As known in the art, the central controller 50 controls certain operations of the printer, including, but not limited to: a) receiving data and control information entered into the printer through an external interface that is electrically coupled to a computer or network of computers; b) providing motor control signals to effect the transport of the print media through the printer; and, c) providing signals to the thermal printhead 36 to control aspects such as activation timing, duration and temperature of the individual printing elements 37. The signals to the printhead 36 from the controller 50 pass through the printhead cable 55.

The data line 62 coupled between the contact point 52 and the microprocessor 58 is further coupled through a resistor 57 to a voltage source, such as +5 volts. With the thermal printhead 36 in the closed position (see FIG. 5A), the contact points 52, 53 are connected together by the bridge element 46, bringing the voltage on the data line 62 to ground (or a binary "zero" state). Conversely, with the thermal printhead 36 in the open position (see FIG. 5B), the contact points 52, 53 are disconnected, and the voltage on the data line 62 is pulled up to the voltage source level (or a binary "one" state) through the resistor 57. Accordingly, the signal detected by the microprocessor 58 on the data line 62 comprises a printhead status signal that can be utilized to halt operation of the printer when the printhead is in the open position.

In an alternative embodiment of the invention, the circuit board 44 may be configured with only a single contact point 52 coupled to the data line 62, with the bridge element 46 coupled to ground through its attachment to the mounting deck 12. As in the previous embodiment, the voltage on the data line 62 will go to ground with the thermal printhead 36 in the closed position (see FIG. 5A), and will be pulled up to the voltage source level through the resistor 57 with the thermal printhead in the open position (see FIG. 5B). This alternative embodiment is advantageous in reducing the number of contact points, but may not be practical if the ground level of the mounting deck 12 is isolated electrically from the ground level of the microprocessor 58. While a separate ground cable could be used to couple to the bridge element 46, this would unnecessarily complicate the printer in a manner sought to avoid in the present invention.

Figure 7:
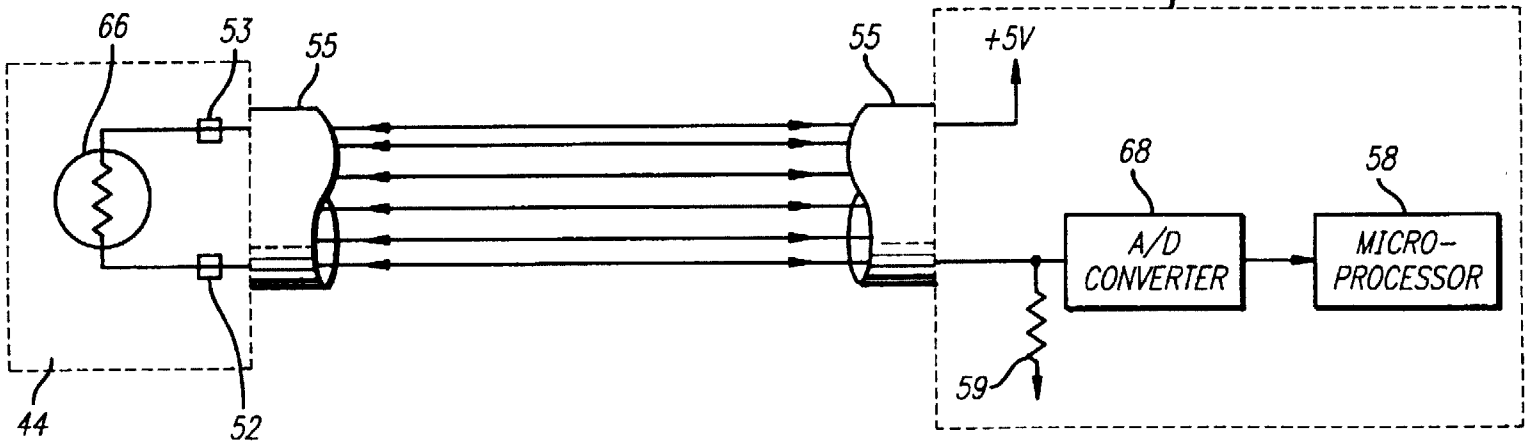
FIG. 7 is a block diagram illustrating electrical connection of an alternative embodiment of the integrated printhead position sensor.

FIG. 7 illustrates another alternative embodiment of the integrated printhead position sensor of the present invention. In this embodiment, a thermistor 66 is included on the circuit board 44 in order to monitor the temperature of the printhead 36 and prevent damage to the printhead due to overheating. As known in the art, a thermistor is a temperature-sensitive resistor having a resistance value that varies with temperature. The respective terminals of the thermistor 66 are coupled to the contact points 52, 53, and are further coupled through respective data lines of the printhead cable 55 to the central controller 50. A first one of the data lines is coupled to a voltage source, such as +5 volts, and a second one of the data lines is coupled to an analog-to-digital (A/D) converter 68. A resistor 59 is coupled between the A/D converter 68 and ground to form a voltage divider circuit. A digitized output of the A/D converter 68 is coupled to the microprocessor 58. In ordinary operation of the printhead 36 in the closed position (see FIG. 5A), temperature fluctuations of the printhead 36 result in corresponding voltage fluctuations at the A/D converter 68. These fluctuating voltage levels are thus converted to digital signals used by the microprocessor 58 in controlling printing operations.

The bridge element 46 can be configured to come into contact with the contact points 52, 53 with the printhead 36 moved to the open position (see FIG. 5B). The contact points 52, 53 may be disposed on an upper surface of the circuit board 44 with the bridge element 46 fixedly disposed above the circuit board to engage the contact points as the printhead 36 pivots upward. When the bridge element 46 shorts between contact points 52, 53, the thermistor 66 is shorted out, causing the voltage level at the A/D converter 68 to rise to a level substantially above the normal operating range for the thermistor. This voltage level can then be interpreted by the microprocessor 58 as the printhead open status signal. It should be appreciated that this alternative embodiment is advantageous since it utilizes two existing data lines of the printhead cable 55, and does not require any changes to the printhead 36. Further, it is not necessary to increase the number of inputs to the microprocessor 58.

Having thus described a preferred embodiment of a thermal printhead with an integrated printhead position sensor, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. A printing apparatus, comprising:

a platen;

a printhead disposed in relation to said platen to permit selectively pivoting of said printhead between a closed position abutting said platen and an open position substantially separated from said platen, said printhead being operable to print information onto a print media transported between said platen and said printhead when said printhead is pivoted to said closed position, said printhead further having a circuit element coupled thereto that pivots in cooperation with said printhead, said circuit element further having first and second electrical contact points; and a bridge fixedly disposed relative to said printhead to come into contact with said first and second contact points only when said printhead is pivoted to one of said open and closed positions, said first and second contact points thereby providing a printhead status signal indicating that said printhead is pivoted to said one of said open and closed positions.

2. The apparatus of claim 1, further comprising a central controller providing control signals that define desired printing operations of said printhead and said platen, said circuit element being operably coupled to said central controller to receive said control signals and provide said control signals to said printhead.

3. The apparatus of claim 2, further comprising a multiline interconnect cable coupled between said circuit element and said central controller for communication of said control signals, said interconnect cable having at least one previously unused line.

4. The apparatus of claim 3, wherein said first contact point is coupled to ground and said second contact point is coupled to said previously unused line.

5. The apparatus of claim 1, wherein said first and second contact points are disposed on a downward facing surface of said circuit element and said first and second contact points come into contact with said bridge upon said printhead being pivoted to said closed position.

6. The apparatus of claim 1, wherein said circuit element further comprises a thermistor adapted to provide a signal corresponding to a temperature value of said printhead, said first and second electrical contacts being coupled to respective terminals of said thermistor.

7. The apparatus of claim 1, wherein said first and second contact points are disposed on an upward facing surface of said circuit board and said first and second contact points come into contact with said bridge upon said printhead being pivoted to said open position.

8. The apparatus of claim 1, wherein said bridge further comprises a spring.

9. A printing apparatus, comprising:

a rotatable platen;

a printhead disposed in relation to said platen permitting a print media to pass therebetween, said printhead being selectively movable between a closed position abutting said platen and an open position substantially separated from said platen, said printhead being operable to print information onto said print media as said print media is transported by rotation of said platen when said printhead is pivoted to said closed position, said printhead further having a circuit board coupled thereto that is movable in cooperation with said printhead;

a central controller providing control signals that define desired printing operations of said printhead and said platen, said circuit board being operably coupled to said central controller to receive said control signals and provide said control signals to said printhead, said circuit board further having at least one electrical contact point disposed on a surface thereon in electrical connection with said central controller; and an electrically conductive bridge element fixedly disposed relative to said printhead to come into contact with said at least one contact point only when said printhead is moved to one of said open and closed positions, said at least one contact point thereby providing a printhead status signal to said central controller indicating that said printhead is pivoted to said one of said open and closed positions.

10. The apparatus of claim 9, further comprising means for biasing said printhead and said platen towards each other such that a predetermined contact pressure is established therebetween.

11. The apparatus of claim 9, wherein said at least one contact point is disposed on a downward facing surface of said circuit board and said open position of said printhead is upward in relation to said closed position, whereby said printhead status signal indicates that said printhead is pivoted to said closed position.

12. The apparatus of claim 9, further comprising a multiline interconnect cable coupled between said circuit board and said central controller for communication of said control signals, said interconnect cable having at least one previously unused line.

13. The apparatus of claim 12, wherein said at least one contact point further comprises a first contact point coupled to ground and a second contact point coupled to said previously unused line.

14. The apparatus of claim 13, wherein said bridge couples said first and second contact points together upon said printhead being moved to said closed position.

15. The apparatus of claim 9, wherein said at least one contact point further comprises a first contact point and a second contact point.

16. The apparatus of claim 15, wherein said circuit board further comprises a thermistor element adapted to provide a signal to said central controller corresponding to a temperature value of said printhead, said first and second electrical contact points being coupled to respective terminals of said thermistor.

17. The apparatus of claim 9, wherein said electrically conductive bridge element further comprises a spring.

18. The apparatus of claim 9, wherein said at least one contact point is disposed on an upward facing surface of said circuit board and said open position of said printhead is upward in relation to said closed position, whereby said printhead status signal indicates that said printhead is moved to said open position.

* * * * *